US010069237B2

(12) United States Patent
Lappoehn

(10) Patent No.: US 10,069,237 B2
(45) Date of Patent: Sep. 4, 2018

(54) HERMETICALLY SEALING CONNECTOR

(71) Applicant: ERNI Production GmbH & Co. KG, Adelberg (DE)

(72) Inventor: Juergen Lappoehn, Gammelshausen (DE)

(73) Assignee: ERNI Production GmbH & Co. KG, Adelberg (DE)

( * ) Notice: Subject to any disclaimer, the term of this patent is extended or adjusted under 35 U.S.C. 154(b) by 0 days.

(21) Appl. No.: 15/535,813

(22) PCT Filed: Dec. 11, 2015

(86) PCT No.: PCT/DE2015/100532

§ 371 (c)(1),
(2) Date: Jun. 14, 2017

(87) PCT Pub. No.: WO2016/095904

PCT Pub. Date: Jun. 23, 2016

(65) Prior Publication Data

US 2017/0346218 A1 Nov. 30, 2017

(30) Foreign Application Priority Data

Dec. 15, 2014 (DE) ..... 10 2014 118 685

(51) Int. Cl.
*H01R 13/52* (2006.01)

(52) U.S. Cl.
CPC ..... *H01R 13/5219* (2013.01)

(58) Field of Classification Search
CPC .. H01R 13/5219; H01R 13/52; H01R 13/523; H01R 13/53; H01R 2101/00; H01R 13/6271; H01R 43/24
(Continued)

(56) References Cited

U.S. PATENT DOCUMENTS 2,785,384 A * 3/1957 Wickesser ..... H01R 9/0521 174/359
3,115,380 A * 12/1963 Kuehl ..... H01R 13/523 174/12 R (Continued)

FOREIGN PATENT DOCUMENTS

DE 24 33 384 A1 2/1975
DE 41 06 714 A1 9/1991

(Continued)

OTHER PUBLICATIONS

International Search Report of PCT/DE2015/100532, dated Apr. 5, 2016.

*Primary Examiner* — Abdullah Riyami
*Assistant Examiner* — Vladimir Imas
(74) *Attorney, Agent, or Firm* — Collard & Roe, P.C.

(57) ABSTRACT

In the case of a connector comprising two plug parts that can be plugged into one another with front housing parts adapted to one another (100, 200) as well as electrical contact elements (120, 220) adapted to one another, wherein the two front housing parts (100, 200) in the plugged together state overlap on regions facing one another (225), provision is made in particular that the two front housing parts (100, 200) outwardly seal the plug connection resulting from plugging the two plug parts together by means of a sealing lip (125) arranged on the one front housing part (100) as well as by means of an annular groove (230) arranged on the respective other front housing part (200), which is surrounded inwardly by annular rotary sealing surfaces (235, 235') and surrounded outwardly by an annular rotary collar (225).

6 Claims, 9 Drawing Sheets

(58) Field of Classification Search
USPC ..... 439/281, 282
See application file for complete search history.

(56) References Cited

U.S. PATENT DOCUMENTS 3,707,696 A * 12/1972 Carter ..... H01R 12/78 439/248
3,787,796 A * 1/1974 Barr ..... H01R 13/5221 439/279
3,880,487 A * 4/1975 Goodman ..... H01R 13/50 439/279
3,953,099 A * 4/1976 Wilson ..... H01R 13/50 439/205
3,976,352 A * 8/1976 Spinner ..... H01R 24/40 333/260
3,994,553 A * 11/1976 Kornick ..... H01R 13/53 439/279
4,116,521 A * 9/1978 Herrmann, Jr. ..... H01R 13/53 439/274
4,150,866 A * 4/1979 Snyder, Jr. ..... H01R 13/5205 439/275
4,621,883 A 11/1986 Noguchi
4,768,970 A * 9/1988 Nestor ..... H01R 13/5221 439/278
4,874,327 A * 10/1989 Ip ..... E21B 17/023 439/275
4,886,471 A * 12/1989 Fleshman, Jr. ..... H01R 13/443 439/148
4,892,488 A * 1/1990 Nestor ..... H01R 24/20 439/438
5,234,352 A * 8/1993 Bungo ..... H01R 13/5219 439/282
5,580,266 A * 12/1996 Shelly ..... H01R 13/53 439/281
5,645,442 A * 7/1997 Cairns ..... H01R 13/523 439/201
5,664,954 A * 9/1997 Rea ..... H01R 13/5213 439/125
5,720,629 A * 2/1998 Self, Jr. ..... H01R 13/5208 439/274
6,039,603 A * 3/2000 Wakata ..... H01R 13/5205 439/587
6,336,821 B1 1/2002 Hattori
6,464,543 B2 * 10/2002 Suzuki ..... H01R 13/52 439/281
6,520,788 B2 * 2/2003 Ichida ..... H01R 13/5219 439/271
7,144,271 B1 * 12/2006 Burris ..... H01R 13/5219 439/578
7,338,320 B2 * 3/2008 Kobayashi ..... F16J 13/02 439/275
7,458,838 B2 * 12/2008 Itou ..... H01R 13/5208 439/271
7,465,192 B2 * 12/2008 McKenzie ..... H01R 13/5208 439/275
7,481,584 B2 * 1/2009 Cairns ..... H01R 13/5219 385/60
7,857,647 B2 * 12/2010 Bracci ..... H01R 13/5205 439/274
7,892,004 B2 * 2/2011 Hertzler ..... H01R 13/5219 439/312
8,323,047 B2 * 12/2012 Reusche ..... H01R 13/5219 411/417
9,172,175 B2 * 10/2015 Spencer ..... H01R 13/58
9,343,846 B2 * 5/2016 Burrow ..... H01R 13/523
9,478,895 B2 10/2016 Lappoehn
9,583,868 B2 * 2/2017 McIntosh ..... H01R 13/521

FOREIGN PATENT DOCUMENTS

DE 10 2007 024 475 A1 11/2008
DE 10 2012 025 107 A1 6/2014
EP 0 021 864 A1 1/1981
EP 0 091 770 A2 10/1983

* cited by examiner

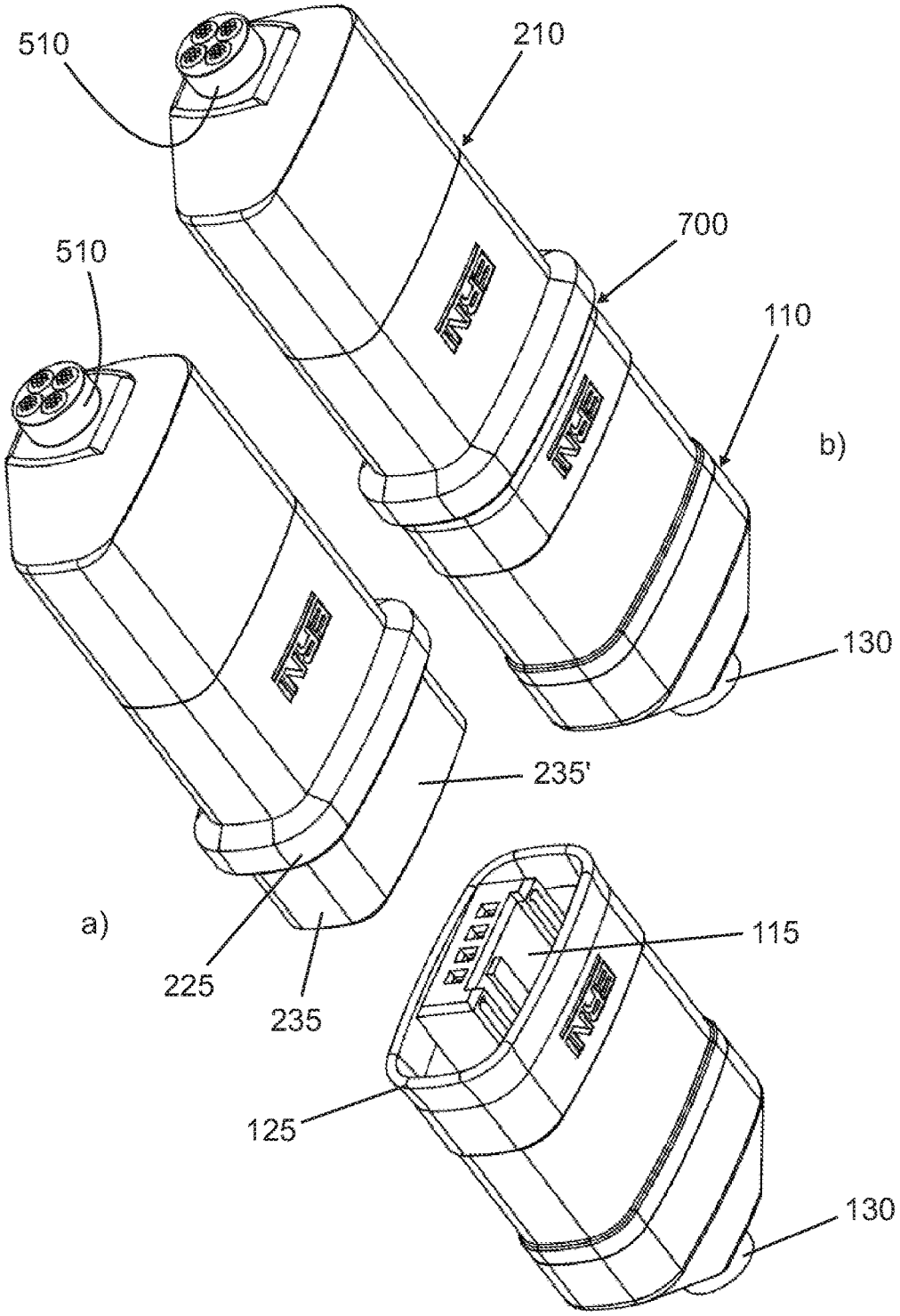
Fig. 7a,b

HERMETICALLY SEALING CONNECTOR

CROSS REFERENCE TO RELATED APPLICATIONS

This application is the National Stage of PCT/DE2015/100532 filed on. Dec. 11, 2015, which claims priority under. 35 U.S.C. § 119 of German Application No. 10 2014 118 685.0 filed on Dec. 15, 2014, the disclosures of which are incorporated by reference. The international application under PCT article 21(2) was not published in English.

The invention relates to a connector, comprising two plug parts that can be plugged into one another, according to the preamble of claim 1.

PRIOR ART

As is known, a relevant sealing connector has a contact housing with chambers for contact elements and a counter-contact housing with corresponding chambers for counter-contact elements. Both contact housings are detachably plugged together in the direction of their central longitudinal axis. In the plugged in state, the two housings overlap with the regions facing one another, wherein the contact housing receives the counter-contact housing. In the base wall facing said counter-contact housing, the contact housing is provided with plug-in holes for the plug contacts corresponding to one another, and the counter-contact housing has plug-in holes in a front wall constructed in its interior and facing the base wall. In the overlap region an annular space is formed between the housings, in which an annular elastic seal is arranged. On the side turned away from the overlap region, the two housings are provided with cable passages.

EP 0 091 770 A2 discloses such a connector with two housing parts, in which a seal is designed as an axial seal, which is also radially compressed and said seal is arranged between a shoulder surface on the contact housing and a partition wall on the supply side on the counter-contact housing. In the process an annular seal engages in an annular receptacle or recess of one of the housing parts and is pressed or compressed by means of a collar protruding on the other housing part in the merging of the two housing parts perpendicular to the ring plane. As a result, the seal is radially expanded and presses with its outer circumferential surface and its inner circumferential surface against the inner circumferential surface of the recess and the outer circumferential surface of the one housing part. The seal described there is accordingly compressed both axially as well as radially, wherein a shoulder surface is required on the inner circumferential wall of the recess in order to be able to press the seal together axially.

An electrical connector is known from DE 41 06 714 A1, in which two plug parts that can be detachably plugged together in the direction of its central longitudinal axis and can be locked with one another are provided. The one plug part is a housing, in which chambers for contact elements and cable passage holes extending from the chambers to the rear are arranged. The other plug part is a pot-shaped receiving housing, which has chambers for counter-contact elements, and into which the housing is inserted when the plug parts are plugged together, wherein plug-in holes are provided in the front wall of the housing and the base wall of the receiving housing for the contact elements corresponding to one another. An annular elastic seal is arranged in the annular space formed in between the circumferential surface of the housing and the inner circumferential surface of the receiving housing, said annular elastic seal being positioned between a shoulder surface on the housing and a partition wall on the supply side. In the case of this connector both partitions axially confining the seal and the sealing space accommodating it are arranged on the housing, so that the size of the gap of the partitions from one another is essentially always the same and thus can be easily adapted to the width of the seal. The sealing between the housing and the receiving housing is carried out by seating the seal with a radial excess between the inner circumferential surface of the receiving housing and the outer circumferential surface of the housing.

Furthermore, a sealed connector housing is known from DE 10 2007 024 475 A1, which has a contact housing with chambers for contact elements and a counter-contact housing with chambers for counter-contacts which can be plugged together detachably in the direction of their central longitudinal axis. The contact housing and the counter-contact housing overlap, in the plugged in state, with the regions facing one another such that the contact housing accommodates the counter-contact housing. The connector housing described there has in addition cable passages arranged on the side turned away from the overlap region as well as an annular elastic seal between the two contact housings in the overlap region. The seal is firmly connected to the receiving contact housing and, in the axial direction, fills a recess in the cable passage side wall of the contact housing. The seal is furthermore arranged on the outside of an annular flange moulded on the inside of the cable passage side wall of the contact housing and constructed as radial seal opposite the counter-contact housing. The seal furthermore has grooves running in the circumferential direction with sealing bars formed by said grooves.

If the counter-contact housing described in DE 10 2007 024 475 A1 is inserted into the contact housing, its wall engages in the annular clearance constructed in the contact housing and in the process compresses the seal in the radial direction. In a desired plug position the annular front surface of the counter-contact housing borders on the annular inner surface of the wall. In this position the two housings are snapped together, to which end snapping elements corresponding to one another are arranged on their exteriors.

DISCLOSURE OF THE INVENTION

An inventive connector comprises two plug parts that can be plugged into one another with front housing parts adapted to one another as well as electrical contact parts adapted to one another, wherein the two front housing parts in the plugged together state overlap on regions facing one another. In particular provision is made that the two front housing parts outwardly seal the plug connection resulting from plugging the two plug parts together by means of a sealing lip arranged on the one front housing part as well as by means of an annular groove arranged on the respective other front housing part, which is surrounded inwardly by annular rotary sealing surfaces and outwardly by an annular rotary collar. By the cooperation of the mentioned sealing lip, groove and collar, an especially good outward sealing arises from plugging together two such plug parts, in particular against splashing water or the like.

Advantageous further developments and improvements of the mentioned connector specified in the independent claim are the subject matter of the dependent claims.

Thus provision can be made that the ratio between the axial height or length of the sealing surface and the axial height of the collar $h_{Sealing\ surface}/h_{Collar}$ lies in the range of 4/1 to 6/1. As a result, on the one hand there is a very good sealing effect and on the other hand a relatively low frictional exertion of force both when the two plug parts are plugged together as well as also when an existing plug connection is disconnected.

The mentioned sealing effect with simultaneously low exertion of force can be considerably improved by building the one front housing part (200) from an elastically deformable, rubber-like material and the respective other front housing part (100) from an essentially non-elastically deformable, rigid material. As a result, a positive and/or non-positive connection can be more easily established and disconnected again, wherein the sealing effect is already very efficient due to the elasticity of the softer material.

The mentioned sealing effect with simultaneously low exertion of force can be improved even more if the groove has a bend pointing radially outward towards the base of the groove, by means of which the sealing lip is elastically pre-stressed radially outward after the two plug parts are plugged together. Due to the deformation or tilting produced as a result in the region of the sealing lip an even more effective sealing arises. In the process, the bend occurs preferably in the region of the height $h_{Collar}$ of the collar, as a result of which especially great elastic pre-stressing of the sealing lip can be produced.

In the case of a connector, in which the electrical contact elements of at least one plug part are arranged in a connector body, provision can furthermore be made that the connector body has an external contouring outside extending at least partially in the longitudinal direction of the plug part, which cooperates with a corresponding internal contouring of the respective front housing part in the case of the joining of the connector body and the front housing part such that a positive and/or non-positive or frictionally engaged connection arises. As a result of this contouring, in particular the production of such a plug part is considerably simplified.

Provision can also be made that the plug parts on the respective cable-side end each have a rear housing part separate from the front housing part, which is built by overmoulding and/or moulding of an injectable and/or mouldable sealing material. As a result, the production of such a plug part is simplified even more.

BRIEF DESCRIPTION OF THE DRAWINGS

Exemplary embodiments of the invention are shown in the drawings and described in greater detail in the subsequent description, wherein identical or functionally equal components are referenced with matching reference numbers.

The figures show the following:

FIG. 7*a, b* illustrate the creation of a plug connection with plug parts shown in FIG. 4*b* and FIG. 6*b*.

EMBODIMENTS OF THE INVENTION

Figure 1:
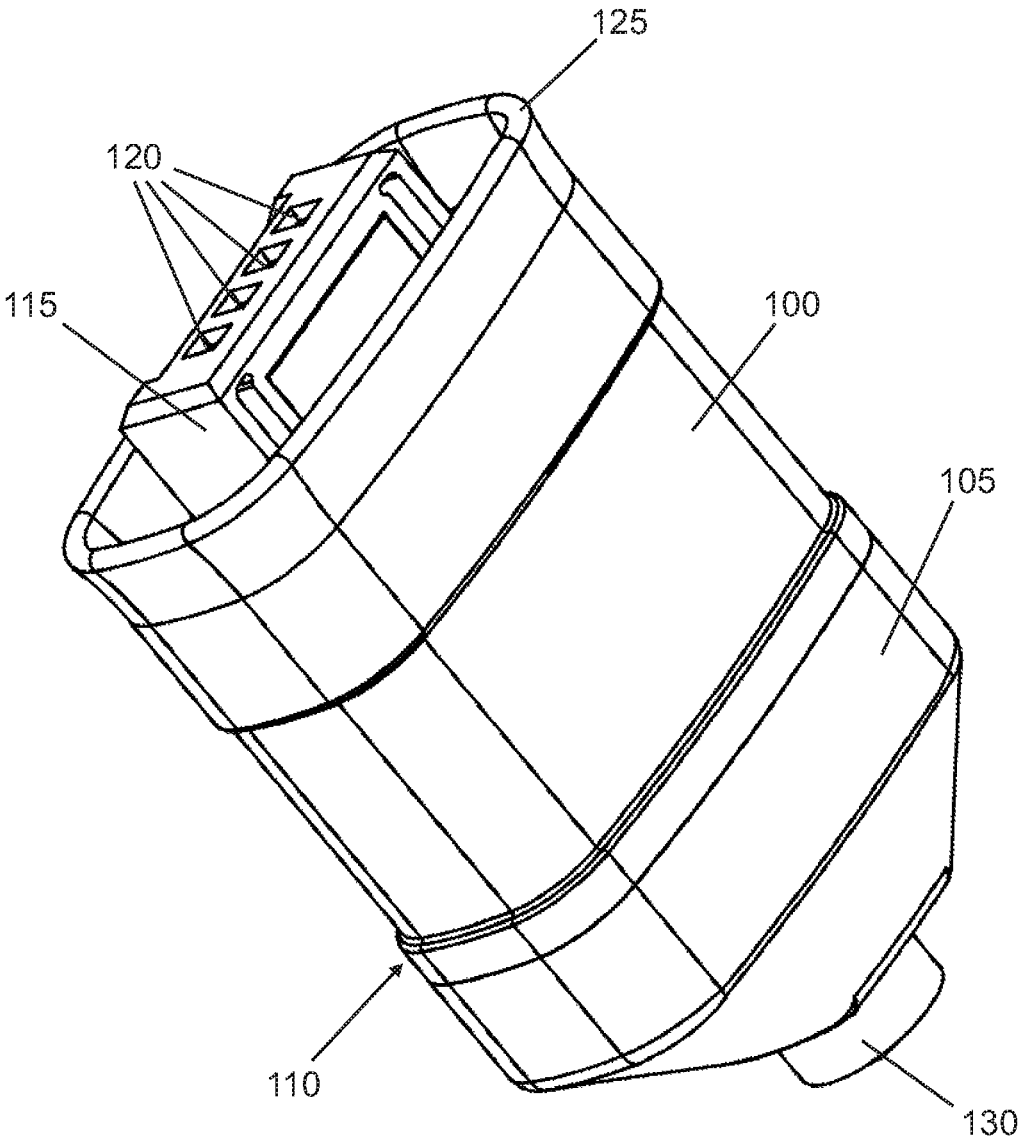
FIG. 1 an isometric representation of an inventive first plug part of a relevant connector, namely in a diagonal view from above.

A first plug part shown in FIG. 1 has a front housing part 100 as well as a rear housing part 105. The two housing parts 100, 105 are hermetically sealed at their transition 110 in particular from splashing water. The production of such a transition 110 will be described in greater detail in the following. Inside the front housing part 100, a first connector body 115 is arranged, which in the present exemplary embodiment has four counter-contact elements 120. The counter-contact elements 120 cooperate with the following described contact elements of a second plug part, e.g. contact pins, in order to be able to establish with it a four-wire electrical plug connection.

The connector body 115 or the counter-contact elements 120 preferably correspond to a conventional connector. The first plug part thus corresponds in its function to a so-called female connector.

The front housing part 100 bordering the connector body 115 consists of a relatively soft or rubber-like material and forms a sealing element both with respect to the mentioned second plug part as well as with respect to the mentioned connector body 115. The front housing part 100 has, for the mentioned purpose, an inner contour to be described in detail in the following, which engages or snaps into place in a contouring arranged on the exterior of the connector body 115, as a result of which a mechanically stable and at least water-proof connection is established between the connector body 115 and the front housing part 100. The front housing part 100 has, on the side accessible to the counter-contact elements 120, a sealing lip 125 visible in this representation, whose exact mode of operation will be explained more thoroughly in the following.

The rear housing part 105 arranged on the cable-side end of the first plug part is, in the present exemplary embodiment, formed by an overmoulding of the corresponding cable-side part of the connector body 115 from a mouldable and/or injectable sealing plastic or rubber. This overmoulding serves in particular for sealing this part of the connector body from splashing water by bordering as well as a cable harness 130 only implied in FIG. 1, which serves to supply electrical power for the counter-contact elements 120.

Figure 2:
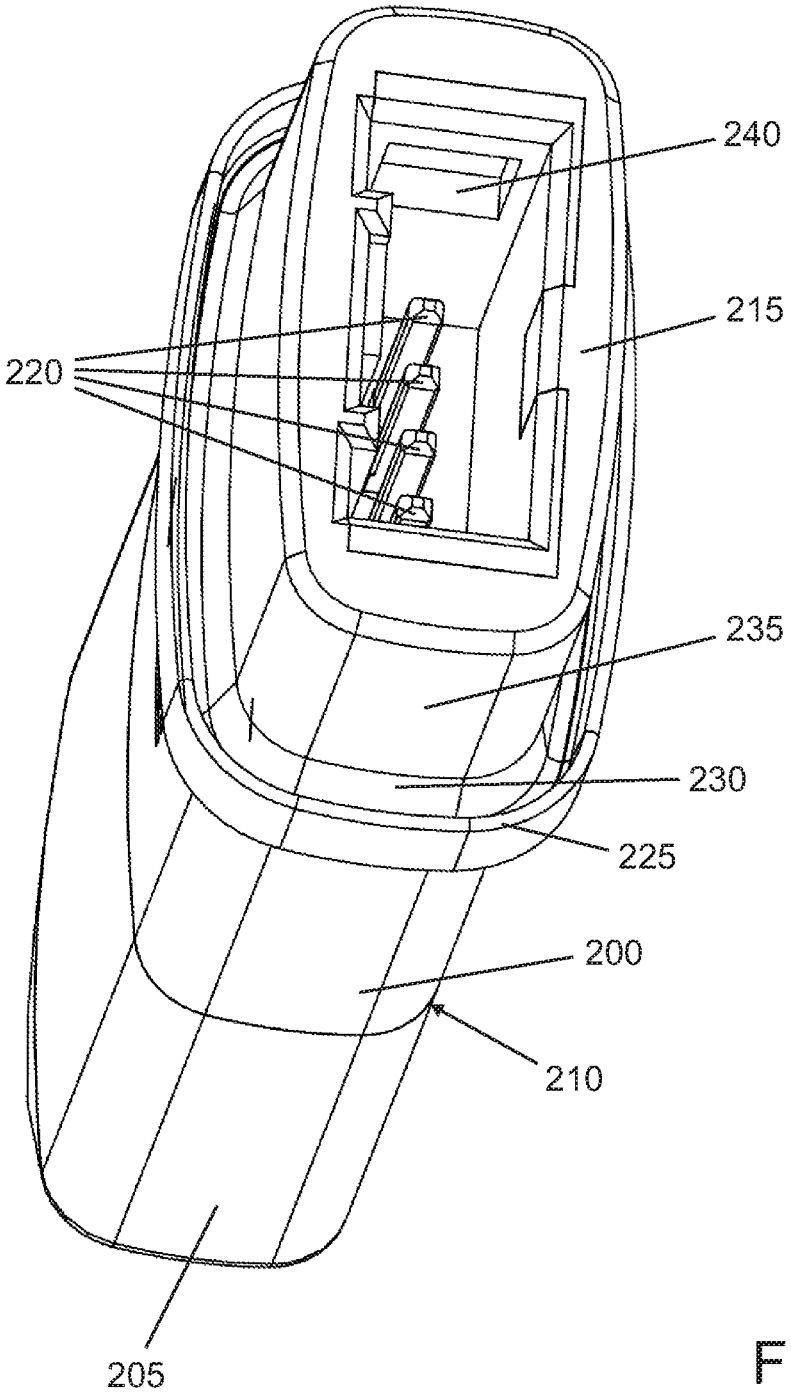
FIG. 2 an isometric representation of an inventive second plug part of a relevant connector, namely in a diagonal view from the front.

A second plug part shown in FIG. 2, cooperating with a first plug part shown in FIG. 1 comprises likewise a connector-side front housing part 200 as well as a cable-side rear housing part 205. The two housing parts 200, 205 are in particular joined together at a seam 210 in sealing manner against splashing water. The production of such a sealing seam will be described in detail in the following. In the front housing part 200, in turn a connector body 215 is arranged, which is mounted firmly seated in the front housing part 200, in order to afford a mentioned protection from splashing water also on the front of the second plug part.

In the present exemplary embodiment, the connector body 215 has, as contact elements, four contact pins in a manner known per se mounted with or without springs 220 and thus corresponds in its mode of operation to a multipole connector. In the case of the joining of the first plug part (FIG. 1) and of the second plug part (FIG. 2) the contact pins 220 engage in the corresponding counter-contact elements 120, so that corresponding electrical connections are established.

The plug parts shown in FIGS. 1 and 2 cooperate in the manner described in the following, in order, after the connection or plugging together of two such plug parts, to provide a plug connection protected from e.g. splashing water.

The plug part shown in FIG. 2 has a sealing collar 225 as well as a groove 230, wherein in the joining of the second plug part and of the first plug part, the collar 225 pulls on the front housing part 100 of the first plug part acting as a sealing element shown in FIG. 1, in order as a result to achieve a hermetic sealing protection in particular from splashing water.

In contrast to the front housing part of the first plug part, the front housing part of the second plug part forming the collar 225 is made of a relatively firm or hard plastic, rubber, metal, or the like. In the process, the sealing effect arises through the combination of the mentioned collar 225, the groove 230 and of a sealing surface 235, namely in particular through the tight fit of the interior on the exterior of the second plug part forming a mentioned sealing surface 235 due to the elasticity of the front housing part of the first plug part as well as the non-positive fit of the sealing lip 125 of the first plug part on the groove 230 of the second plug part due to the elasticity.

The relative dimensions or proportions between the height of the sealing surface 235 and the height of the collar 225 range, for example for $h_{Sealing\ surface}/h_{Collar}$, from 5/1.

On the second plug part according to FIG. 2 in addition, on both sides of the connector opening arranged on the front housing part 200, a recess 240 is arranged for snapping in a corresponding snapping element of the first plug part, by means of which a mentioned detachable connection between the two plug parts occurring with an elastic pre-stressing is made possible.

Figure 3:
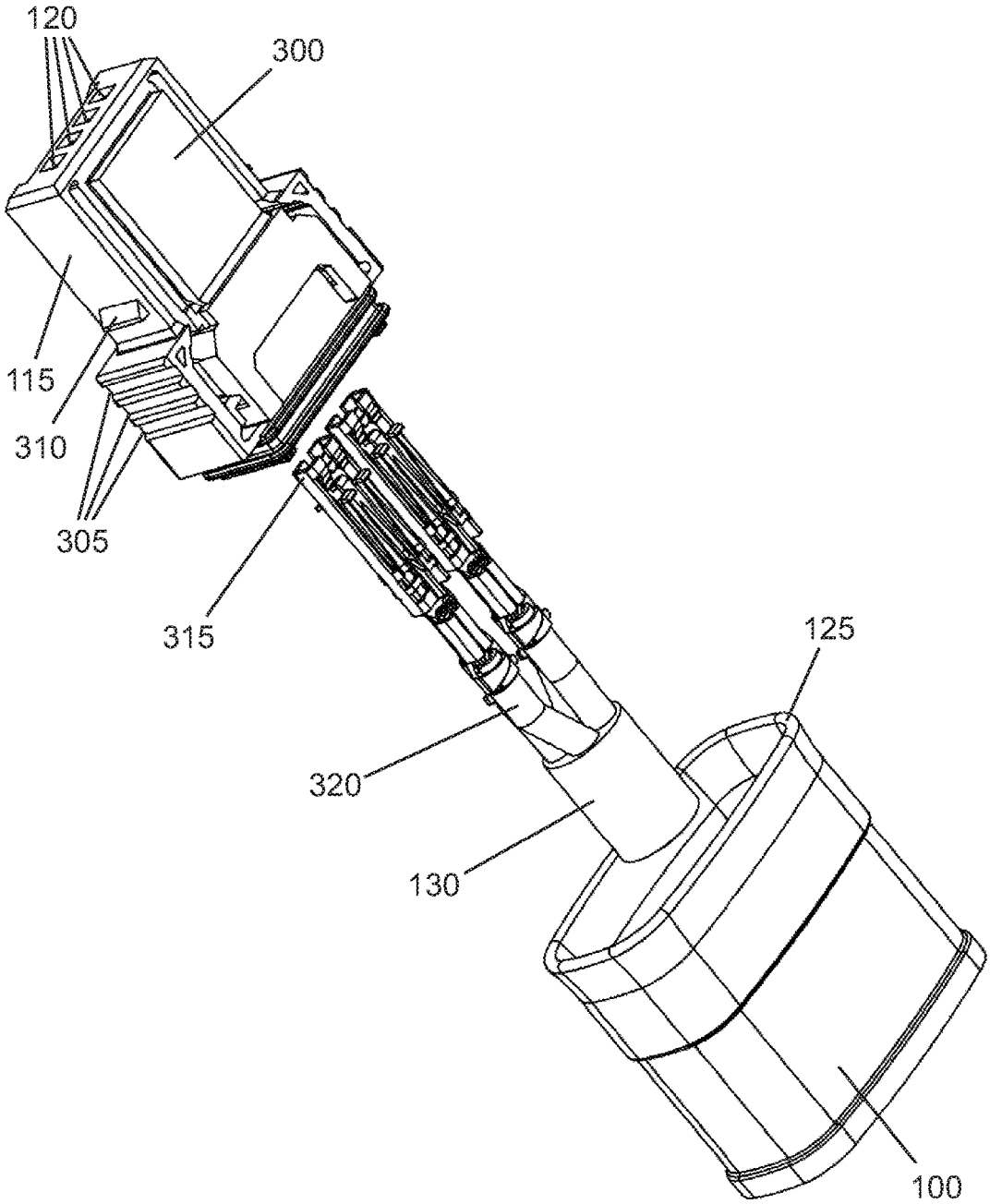
FIG. 3 an isometric exploded view of a first plug part shown in FIG. 1, namely in the state prior to the assembly of a corresponding connector housing, of a corresponding connector body as well as of a cable harness provided for the connector.

With the assistance of FIG. 3 a description is given of how a first plug part shown in FIG. 1 is produced. The individual components are:

1. a front housing part 100 with a sealing lip 125,
2. a cable harness 130 with four counter-contact elements 315 and four corresponding electrical conductors 320, as well as
3. a connector body 115 with four recesses 120, in which the mentioned contact pins 315 engage after the assembly and form a mentioned counter-contact element 120.

On one side of the connector body 115, in the present exemplary embodiment, an assembly element 300 is arranged, in order in particular to make the assembly or the production of the front housing part 100 easier, for example by locking into position. In the local contouring 305 of the connector body 115 visible in this representation, in the present exemplary embodiment web-shaped in design, an essentially mirror-inverted inner contour of the front housing part 100 not shown here engages or snaps into place. Two noses or locking noses arranged laterally on the connector body 115, of which in the representation only one locking nose 310 can be seen, in the case of the joining or plugging together of the first plug part and of the second plug part engage in a respective mentioned recess 240 of the second plug part.

Figure 4:
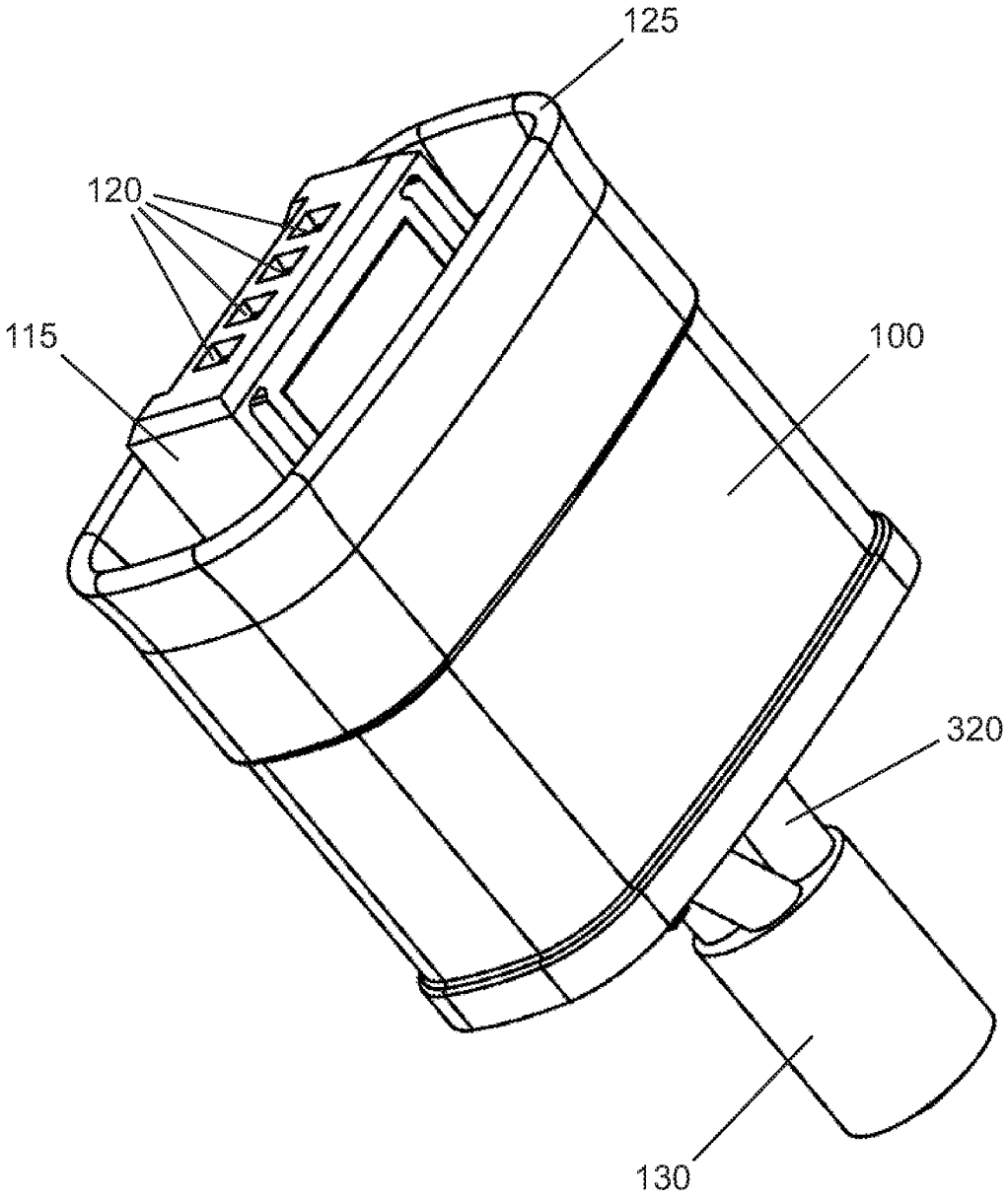
FIG. 4 an isometric representation of a first plug part shown in FIG. 3 after the assembly, however, before the attachment of a housing seal shown in FIG. 1 on the cable side.

FIG. 4 shows a first plug part according to FIG. 3, namely after the assembly of the components shown in FIG. 3, however before the creation of a rear housing part 105 shown in FIG. 1 or of a corresponding cable-side housing seal. FIG. 4 illustrates how a front housing part 100 having a sealing lip 125 is designed after the assembly with a connector body 115 shown in FIG. 3 as well as corresponding counter-contact element 120. It can also be seen that a rear housing part 105 shown in FIG. 1 or the corresponding housing seal is not yet arranged, so that the cable harness 130, and in particular the four electrical conductors or cables 320, are still unprotected outwardly.

With the assistance of FIG. 5 a description will now be given of how a second plug part shown in FIG. 2 is produced. The individual components are:

1. a front housing part 200 with a sealing collar 225 as well as sealing surfaces 235, 235',
2. a cable harness 510 with four contact elements in the form of contact pins 220 and four corresponding electrical conductors 507, in each case combined in pairs 505, as well as
3. a connector body 500 with openings 515 forming recesses 240, in which, in the case of the joining or plugging together of the two plug parts, e.g. a locking nose 310 shown in FIG. 3 engages.

Figure 5:
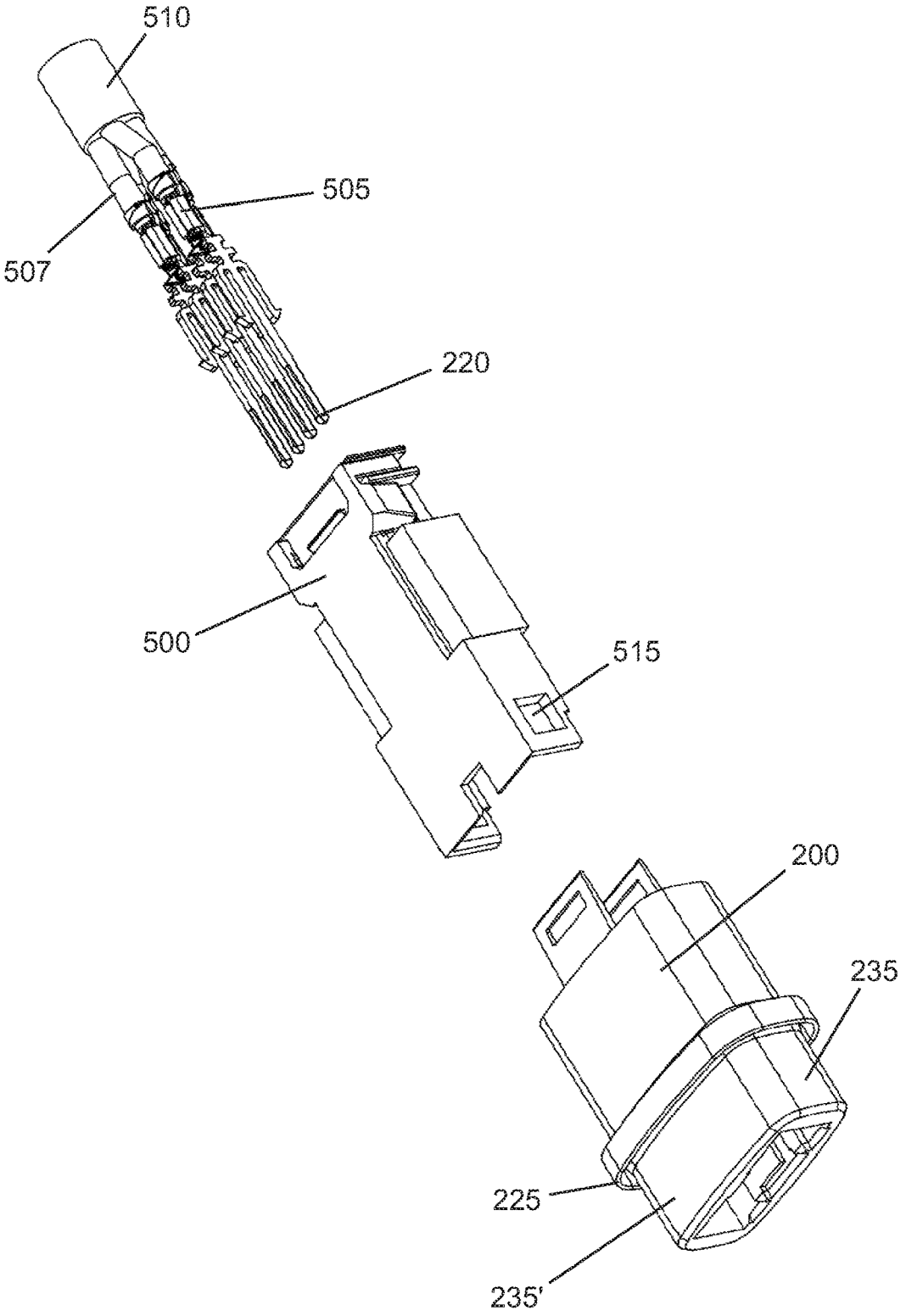
FIG. 5 an isometric exploded view of a second plug part shown in FIG. 2, namely in the state prior to the assembly of a corresponding connector housing, of a corresponding connector body as well as of a cable harness provided for the connector.
Figure 6A:
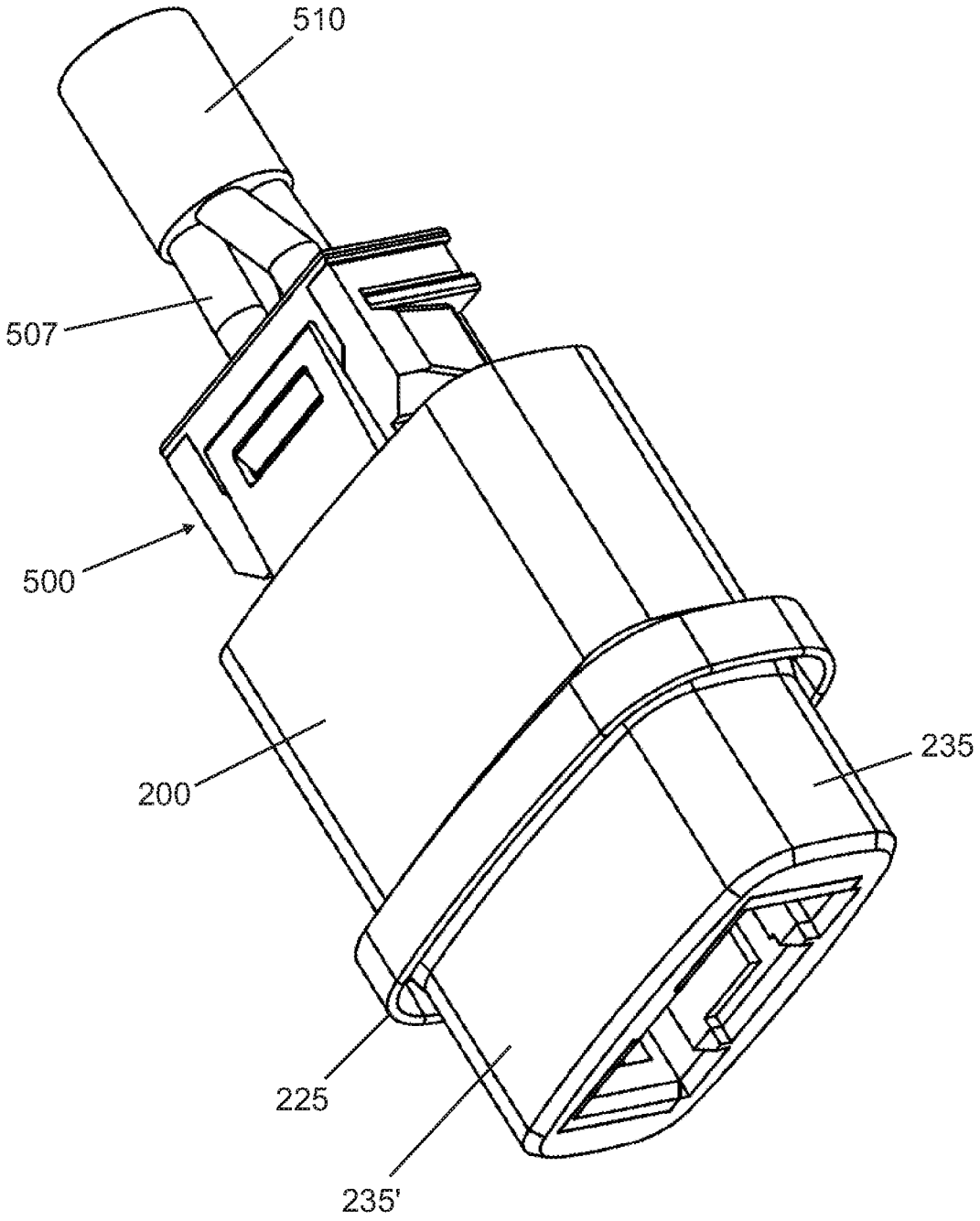
FIG. 6*a, b* isometric representations of a second plug part shown in FIG. 5 immediately after the assembly (FIG. 6*a*) as well as after the creation of a cable-side seal (FIG. 6*b*)

FIG. 6*a* shows a second plug part according to FIG. 5, namely after the assembly of the components shown in FIG. 5, however before the creation of a rear housing part 205 shown in FIG. 2 or of a corresponding cable-side housing seal. The front housing part 200 of the shown second plug part is, in the present exemplary embodiment, formed or produced from a harder material compared to the front housing part 100 of the first plug part. One advantage of this material embodiment is the fact that, in the case of the plugging together of the first and of the second plug part an especially good positive and in particular non-positive connection and as a result a mentioned hermetic sealing of the plug connection is formed.

Since, in the case of these embodiments, only one of the two front housing parts 100, 200 is implemented to be relatively soft, both plug parts can be plugged together without great exertion of force. It should however be noted that the two front housing parts 100, 200 can be produced from the same relatively hard or relatively soft material, which however either causes a worse sealing in comparison to the first embodiment or requires a greater exertion of force when the two plug parts are plugged together.

From FIG. 6*a* it can furthermore be seen how a front housing part 200 having a collar 225 as well as sealing surfaces 235, 235' is designed, after the assembly, with a connector body 500 isometrically represented in FIG. 5 as well as corresponding contact elements 220, concealed in this representation by the outer surface 235' of the front housing part 200 or not visible. In particular it can also be seen here that a rear housing part 205 shown in FIG. 2 or the corresponding housing seal is not yet attached, so that the rear part of the connector body 500 as well as the cable harness 510 with the four electrical conductors 507 are still unprotected outwardly.

Figure 6B:
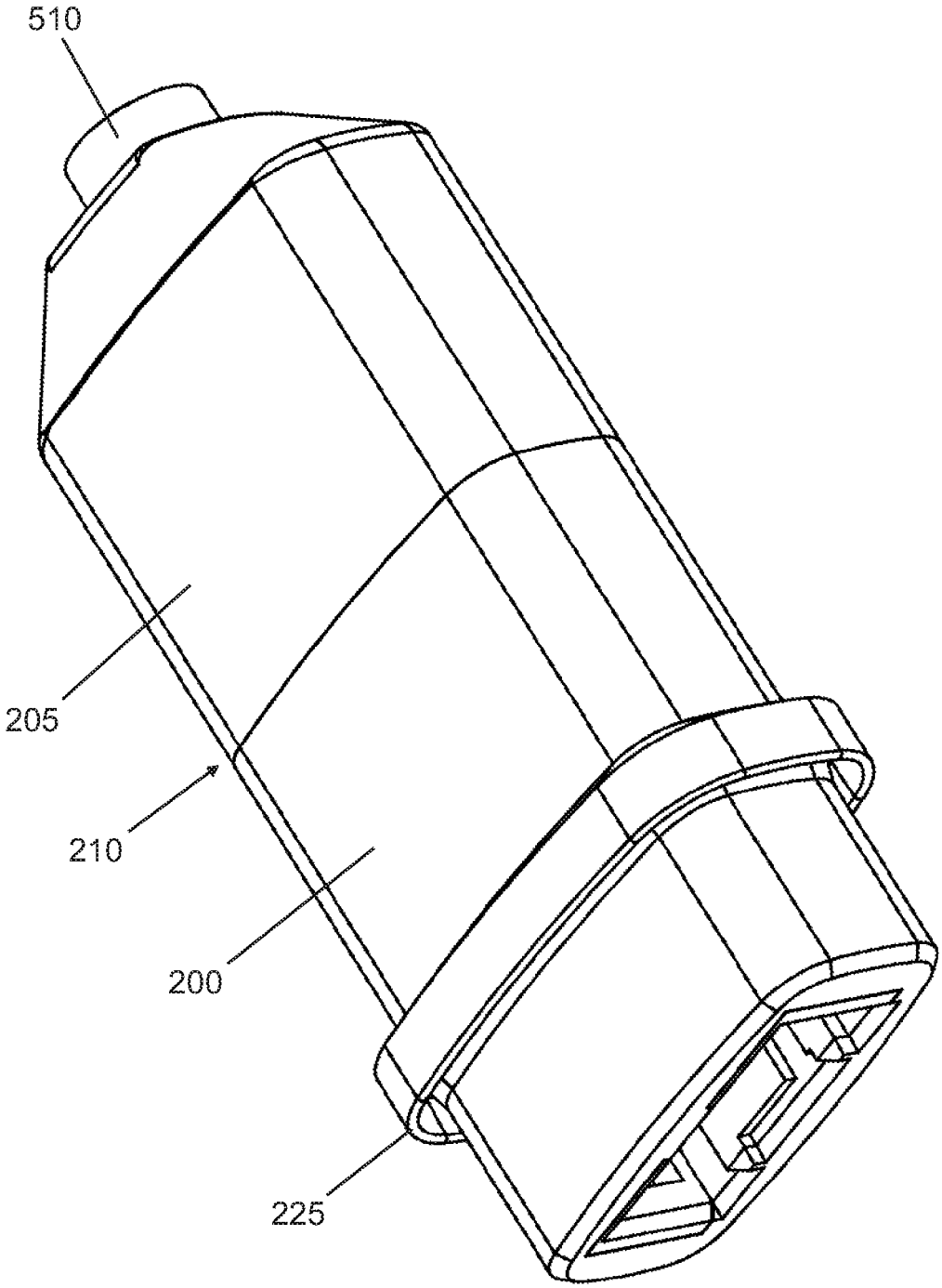

FIG. 6*b* shows an isometric representation of a second plug part finished according to FIG. 6*a*, in which a rear housing part 205 has already been produced, e.g. by overmoulding with a mentioned suitable material. At the connection 210 between the front housing part 200 and the rear housing part 205, the mentioned connection seam, usually visible from the outside, can be recognized.

With the assistance of FIGS. 7*a* and 7*b* it is shown how a previously described finished first plug part and a second plug part are plugged together, in order to provide a relevant, outwardly sealing electrical plug connection. In so doing, FIG. 7*a* shows the situation prior to the plugging together and FIG. 7*b* shows the established plug connection. It should be emphasized that in the case of the plug connection shown in FIG. 7*b*, all transitions are essentially hermetically sealed outwardly, in particular protected from the penetration of splashing water. These transitions include the transition between the respective rear housing parts to the respective cable harnesses 130, 510, the seams 110, 210 between the respective front and respective rear housing parts as well as the plug contact region 700 between the two plug parts.

Figure 8:
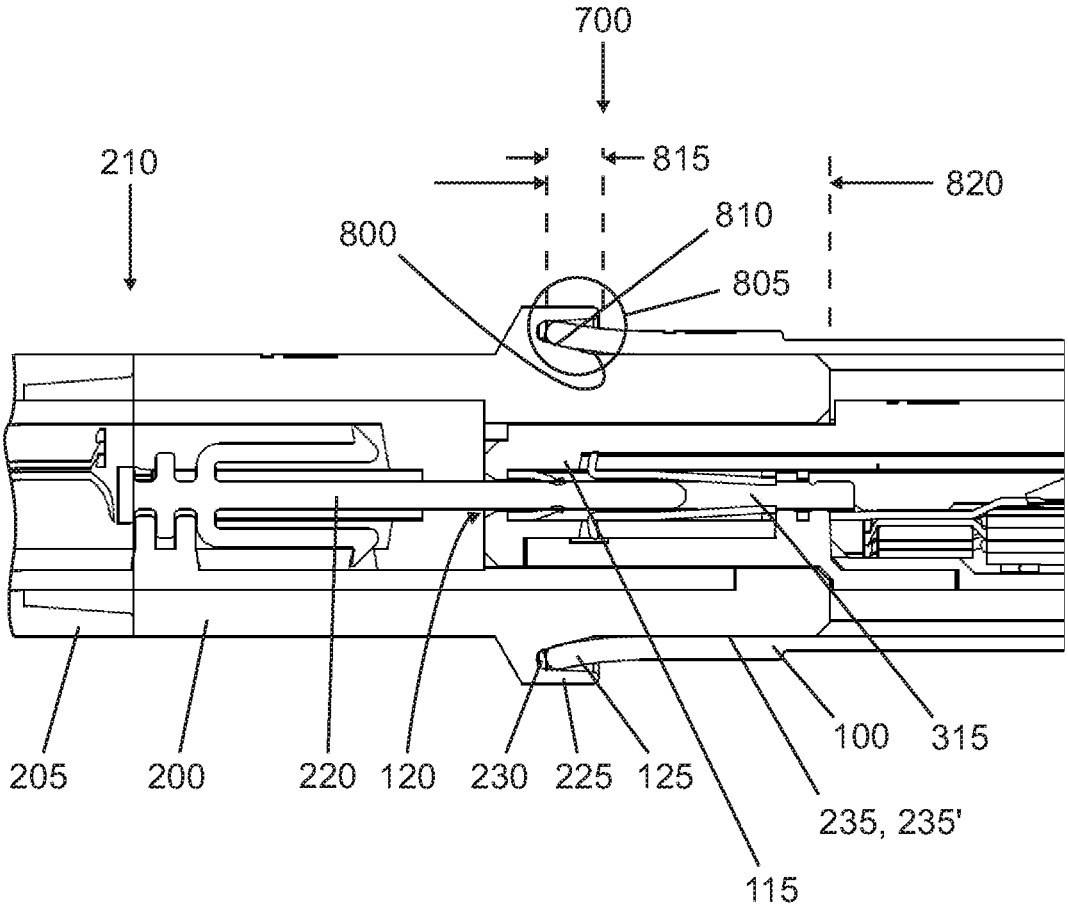
FIG. 8 a longitudinal section along the central axis of a plug connection created according to FIG. 7*b* with plug parts shown in FIG. 4*b* and FIG. 6*b*.

FIG. 8 shows a longitudinal section produced along the central axis (or slightly offset laterally to the central axis) of a plug connection created according to FIG. 7*b*, namely a section cut of such a plug connection on both sides of the plug connection in a mentioned plug contact region 700.

The section schematically represented in FIG. 8 shows already described elements or components of the connector. On the right side of the representation, the front housing part 100 of the first plug part, the first connector body 115 with the counter-contact elements 120 as well as the sealing lip 125 arranged on the first plug part are shown. On the left side there are elements of the second plug part, namely the corresponding connector-side front housing part 200, the cable-side rear housing part 205, as well as the seam 210 on the connection or the transition between the two housing parts 200, 205. Furthermore, from FIG. 8 it can be seen how the contact pins 220 of the second plug part engage in the plugged together state in the respective recesses 120 of the connector body 115 and finally in the mentioned counter-contact sleeves 315.

In FIG. 8 in addition in particular the mentioned collar 225, the groove 230 as well as the sealing surface 235, 235' are shown. From this representation in particular it can be seen how the groove 230 formed by the collar 225 bends at the height of the collar edge 800. Through this bend 800 the front housing part 100 of the first plug part shown on the right in the region of the sealing lip 125 is elastically deformed somewhat radially outward 805. Through this additional deformation or tilting in the region of the sealing lip 125 an improved sealing arises, since as a result an elastically pre-stressed sealing line 810 encompassing the annular groove 230 in the radial interior of the groove 230 is formed.

FIG. 8 also indicates how the mentioned height $h_{Collar}$ 815 of the collar 225 as well as the height $h_{Sealing\ surface}$ 820 of the sealing surface 235, 235' are defined.

It is to be noted that the arrangement of four contact or counter-contact elements described above is only exemplary and the present invention can also be used correspondingly in plug connections with more or fewer contact elements.

The invention claimed is:

1. Connector, comprising two plug parts that can be releasably plugged into one another with front housing parts adapted to one another (100, 200) as well as electrical contact elements (120, 220) adapted to one another, wherein the two front housing parts (100, 200) in the plugged together state overlap on regions facing one another (225), wherein the two front housing parts (100, 200) outwardly seal the plug connection resulting from plugging the two plug parts together by means of a sealing lip (125) arranged on the one front housing part (100) as well as by means of an annular groove (230) arranged on the respective other front housing part (200), which is surrounded inwardly by annular rotary sealing surfaces (235, 235') and surrounded outwardly by an annular rotary collar (225), which during putting together of the resulting plug connection, the two plug parts seal themselves toward the outside, wherein the one front housing part (200) is formed of a rigid, essentially non-deformable material and the respective other front housing part (100) is made of an elastically deformable, rubber-like material, and wherein the groove (230) has a bend (800) pointing radially outward towards the base of the groove, by means of which the sealing lip (125) is elastically pre-stressed radially outward after the two plug parts are plugged together.

2. Connector according to claim 1, wherein the ratio between the height of the sealing surface (235, 235') and the height of the collar (225) $h_{Sealing\ surface}/h_{Collar}$ is in the range of 4/1 to 6/1.

3. Connector according to claim 1, wherein the bend (800) is arranged in the region of the height $h_{Collar}$ of the collar (225).

4. Connector according to claim 1, wherein the electrical contact elements (120, 220) of at least one plug part are arranged in a connector body (115); wherein the connector body (115) has an external contouring (305) outwardly extending at least partially in the longitudinal direction of the plug part, which cooperates with a corresponding internal contouring of the respective front housing part (100, 200) in the case of the joining of the connector body (115) and of the front housing part (100, 200) such that a positive or frictionally engaged connection arises.

5. Connector according to claim 1, wherein the plug parts on the respective cable-side end each have a rear housing part (105, 205), which is formed by overmolding and/or molding of an injectable and/or moldable sealing material.

6. Connector according to claim 5, wherein the rear housing parts (105, 205) are made of an elastically deformable, rubber-like material.

* * * * *